US009232600B2

(12) United States Patent
Hu et al.

(10) Patent No.: US 9,232,600 B2
(45) Date of Patent: Jan. 5, 2016

(54) LIGHT-EMITTING MODULE AND DRIVING METHOD THEREOF

(71) Applicant: CHROMA ATE INC., Guishan Township, Taoyuan County (TW)

(72) Inventors: Che-Cheng Hu, Guishan Township (TW); Chih-Chiao Chang, Guishan Township (TW)

(73) Assignee: CHROMA ATE INC., Guishan Township (TW)

( * ) Notice: Subject to any disclaimer, the term of this patent is extended or adjusted under 35 U.S.C. 154(b) by 0 days.

(21) Appl. No.: 14/546,323

(22) Filed: Nov. 18, 2014

(65) Prior Publication Data

US 2015/0181664 A1 Jun. 25, 2015

(30) Foreign Application Priority Data

Dec. 20, 2013 (TW) ..... 102147462 A

(51) Int. Cl.
*H05B 37/00* (2006.01)
*H05B 33/08* (2006.01)

(52) U.S. Cl.
CPC ..... *H05B 33/086* (2013.01)

(58) Field of Classification Search
CPC ..... H05B 33/0815; H05B 33/0818; H05B 33/086; H05B 37/029; H05B 37/02
USPC ..... 315/201, 294, 297
See application file for complete search history.

(56) References Cited

U.S. PATENT DOCUMENTS

| | | | | |
|---|---|---|---|---|
| 7,719,207 | B2 | 5/2010 | Huang et al. | |
| 7,953,467 | B2 * | 5/2011 | Dabiri | A61B 5/0062 600/407 |
| 7,986,102 | B2 | 7/2011 | Roberts | |
| 2004/0041526 | A1 * | 3/2004 | Vollrath | H05B 33/0818 315/201 |
| 2008/0012502 | A1 | 1/2008 | Lys | |
| 2011/0088440 | A1 * | 4/2011 | Feil | E05B 17/103 70/393 |
| 2011/0248370 | A1 * | 10/2011 | Tsoi | H01L 31/03529 257/437 |

FOREIGN PATENT DOCUMENTS

| | | | |
|---|---|---|---|
| TW | 200934294 | A | 8/2009 |
| TW | 201013351 | A1 | 4/2010 |

* cited by examiner

*Primary Examiner* — Douglas W Owens
*Assistant Examiner* — Syed M Kaiser
(74) *Attorney, Agent, or Firm* — Maschoff Brennan

(57) ABSTRACT

A light-emitting module and a driving method thereof are disclosed. In this method, P light-emitting units are selected as a target group, wherein each of the P light-emitting units has N different power parameters corresponding to N sub-bands. P evaluated current values corresponding to the P light-emitting units are computed according to a target spectrum and the N×P power parameters corresponding to the P light-emitting unit in the target group. An emission-spectrum error is computed according to the target spectrum, the N×P power parameters, and the P evaluated current values. It is determined whether the emission-spectrum error conforms with the determining criteria. When the emission-spectrum error conforms with determining criteria, the P evaluated current values are set to be P driving current values corresponding to the P light-emitting units.

12 Claims, 6 Drawing Sheets

LIGHT-EMITTING MODULE AND DRIVING METHOD THEREOF

CROSS-REFERENCE TO RELATED APPLICATIONS

This non-provisional application claims priority under 35 U.S.C. §119(a) on Patent Application No. 102147462 filed in Taiwan, R.O.C. on Dec. 20, 2013, the entire contents of which are hereby incorporated by reference.

BACKGROUND OF THE INVENTION

1. Technical Field of the Invention

The present invention relates to a light-emitting module and a driving method thereof, and particularly to those using numerical methods to calculate driving current values.

2. Description of the Related Art

Light-emitting modules are very common illumination devices now, and light-emitting modules composed of light-emitting diodes (LEDs) or other highly efficient light-emitting units have become a trend. However, it is not an easy task to use LEDs or other highly efficient light-emitting units to manufacture light-emitting modules with a specific emission spectrum. The general design scenario is repeated trials and errors by engineers with simulations to obtain an acceptable emission spectrum. Therefore, this design method of a light-emitting module with an unusual emission spectrum costs a lot of time. Meanwhile, due to the light decay of long-time usage of the LEDs or other highly efficient light-emitting units, the light emitted from an aging light-emitting module is not only weaker, but also makes a huge difference between the current emission spectrum and the originally designed emission spectrum.

Therefore, a method is needed for computing the driving current of every light-emitting unit in the light-emitting module automatically according to a target spectrum (the originally designed emission spectrum) and the emission spectra of the light-emitting units, and the method must be able to be applied to every light-emitting module.

SUMMARY OF THE INVENTION

Because of the aforementioned problem, the present invention discloses a driving method of a light-emitting module to compute the driving currents corresponding to a plurality of light-emitting units according to a target spectrum and the emission spectra of the light-emitting units, so that the emission spectrum resulting from a combination of the light-emitting units approximates to the target spectrum.

According to the present invention, a driving method of a light-emitting module comprises: disposing P light-emitting units corresponding to different emission spectra so as to constitute a target group, each of the light-emitting units corresponding to N power parameters in respectively N frequency sub-bands, the light-emitting module comprising the target group; computing P evaluated current values corresponding to the P light-emitting units according to a target spectrum and the N×P power parameters corresponding to the P light-emitting units, the target spectrum having N target-spectrum values in the N frequency sub-bands; computing an emission-spectrum error according to the target spectrum, the N×P power parameters and the P evaluated current values corresponding to the target group; determining whether the emission-spectrum error conforms with a criterion; and setting the P evaluated current values as P driving current values corresponding to the P light-emitting units when the emission-spectrum error conforms with the criterion. P and N are positive integers.

In addition, the present invention discloses a light-emitting module applying the aforementioned driving method to compute a plurality of driving currents corresponding to a plurality of light-emitting units according to a target spectrum and the emission spectra of a plurality of light-emitting units, so that the emission spectrum combined by a plurality of light-emitting units approximates to the target spectrum.

According to the present invention, a light-emitting module comprises a target group and a processing unit. Each of the P light-emitting units corresponds to N power parameters in respectively N frequency sub-bands. The processing unit is electrically connected with the P light-emitting units and adapted for computing P evaluated current values corresponding to the P light-emitting units according to a target spectrum and the N×P power parameters corresponding to the P light-emitting units. The target spectrum correspondingly has N target-spectrum values in the N frequency sub-bands. The processing unit computes an emission-spectrum error according to the target spectrum, the N×P power parameters and the P evaluated current values corresponding to the target group, and determines whether the emission-spectrum error conforms with a criterion. When the emission-spectrum error conforms with the criterion, the P evaluated current values are set as the P driving current values of the P light-emitting units to drive the P light-emitting units.

In summary, according to the light-emitting module and the driving method of the present invention, the driving current value for driving every light-emitting unit can be computed according to the target spectrum and the power parameters corresponding to the light-emitting units, so that the spectrum corresponding to the mixed light approximates to the target spectrum. In addition, the power parameters of the light-emitting units can be updated dynamically to relieve the light-emitting module of the present invention of emission-spectrum shift due to light decay.

The contents of the present invention set forth and the embodiments hereinafter are used to demonstrate and illustrate the spirit and theory of the present invention, and to provide further explanation of the claims.

BRIEF DESCRIPTION OF THE DRAWINGS

The present invention will become more fully understood from the detailed description given hereinbelow and the accompanying drawings, which are given by way of illustration only and thus are not limitative of the present invention and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings. In the present invention, N, P, and K all stands for non-negative integers.

Figure 1:
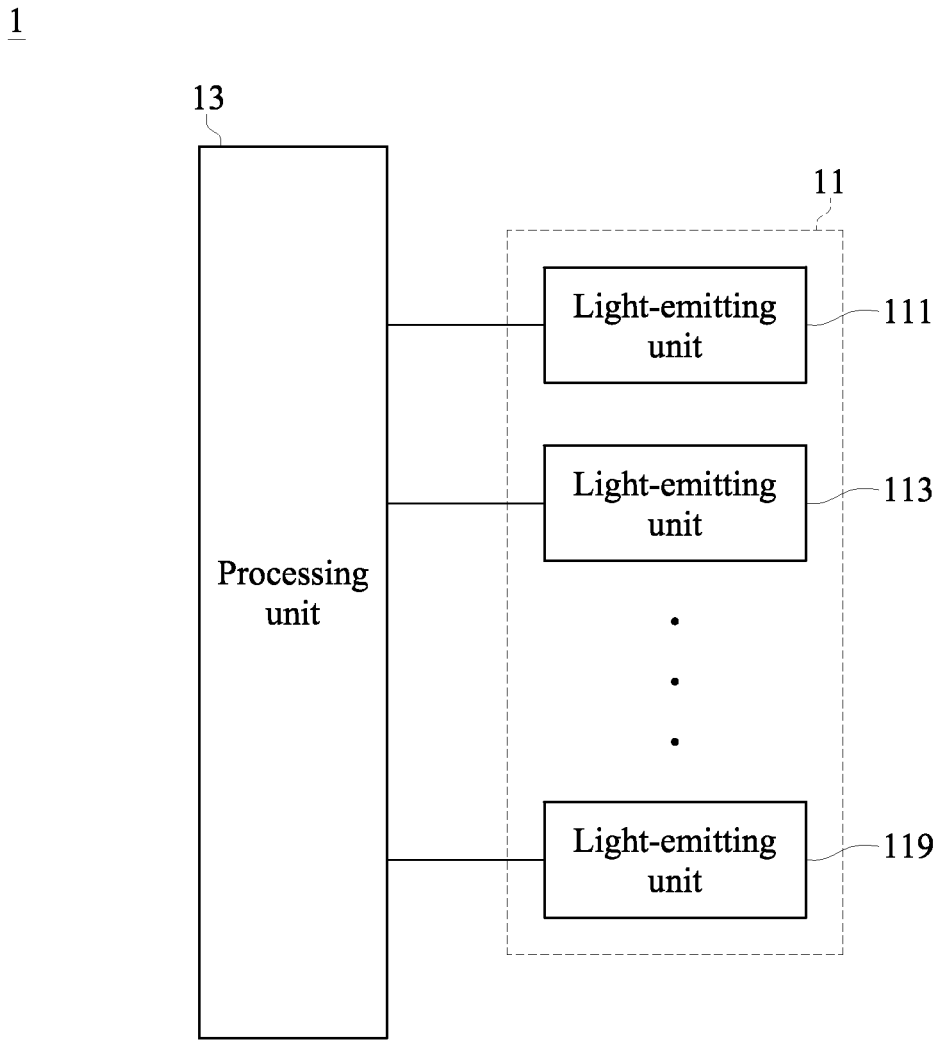
FIG. 1 is a functional block diagram of a light-emitting module according to an embodiment of the present invention.

Please refer to FIG. 1 with regard to a driving method of a light-emitting module of the present invention. FIG. 1 is a functional block diagram of a light-emitting module according to an embodiment of the present invention. As shown in FIG. 1, the light-emitting module 1 comprises a light-emitting component 11 consisting of K light-emitting units and a processing unit 13. The K light-emitting units can be divided into a target group consisting of P light-emitting units and a candidate group consisting of Z light-emitting units, wherein the target group and the candidate group are mutually exclusive. The processing unit 13 is electrically connected with the said K light-emitting units of the light-emitting component 11. The light-emitting module 1 can decide the K driving currents corresponding to the K light-emitting units according to a target spectrum, so that driving the K light-emitting units with the K driving currents approximates the emission-spectrum distribution corresponding to the light emitted by the K light-emitting units to the target spectrum. A plurality of embodiments of the present invention described below are for explaining the operation of the driving method using 9 light-emitting units (light-emitting unit 111 to light-emitting unit 119). However, the present invention does not limit the number of the light-emitting units.

Figure 2:
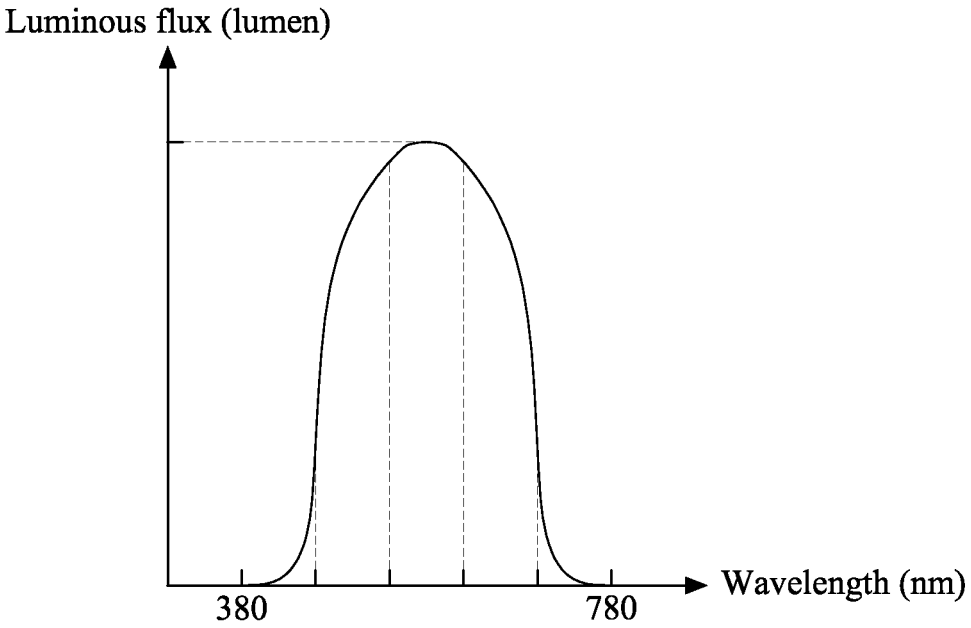
FIG. 2 is a diagram of the light-emitting spectrum of a light-emitting unit according to an embodiment of the present invention.

Each light-emitting unit of the light-emitting unit 111 to the light-emitting unit 119 has a specific emission spectrum. For example, please refer to FIG. 2. FIG. 2 is a diagram of the light-emitting spectrum of a light-emitting unit according to an embodiment of the present invention. As shown in FIG. 2, the emission spectrum of the light-emitting unit 111 can be divided to N frequency sub-bands in the visible light wave band (light wavelength from 380 nm to 780 nm), and each frequency sub-band corresponds to a power parameter. For example, a frequency sub-band corresponds to a wave band of 1 nm, 10 nm, or 100 nm. Persons skilled in the art can bitrarily design the width of the wave band and the present invention does not limit it.

More specifically, the power parameter corresponding to a frequency sub-band can be interpreted as the luminous flux of the light emitted by the light-emitting unit 111 in this frequency sub-band every time one unit of electric current (e.g. 1 mA, 1 μA, or other adequate amount) flows through the light-emitting unit 111. Besides, the emission spectra of the light-emitting units 111 to 119 are not completely the same. For example, in the spectrum corresponding to the light-emitting unit 111, the luminous flux is the highest at the wavelength 420 nm; in the spectrum corresponding to the light-emitting unit 119, the luminous flux of wavelength 700 nm is the highest. Therefore, the method disclosed in a plurality of embodiments of the present invention can adjust the luminous flux of every light-emitting unit in each frequency sub-band by controlling the driving current of every light-emitting unit, and then combine the light-emitting units to obtain a luminous flux distribution that approximates the target spectrum. When the luminous flux distribution corresponding to every frequency sub-band is similar to the target spectrum, it means that the mixed light emitted from the multiple light-emitting units is similar to the target spectrum. According to an embodiment, a light-emitting unit is, for example, a Light-Emitting Diode (LED), an Organic Light-Emitting Diode (OLED), or another electronic device which is able to emit visible light.

The processing unit 13 is adapted for deciding the driving current value of every light-emitting unit among the K light-emitting units (in this embodiment, K=9) according to at least some of the N power parameters corresponding to every light-emitting unit among the K light-emitting units (N×K power parameters in total). According to an embodiment, the processing unit 13 is, for example, an application-specific integrated circuit (ASIC), Advanced RISC Machine (ARM), central processing unit (CPU), single-chip controller, or any other device suitable for computing and executing instructions.

Figure 3:
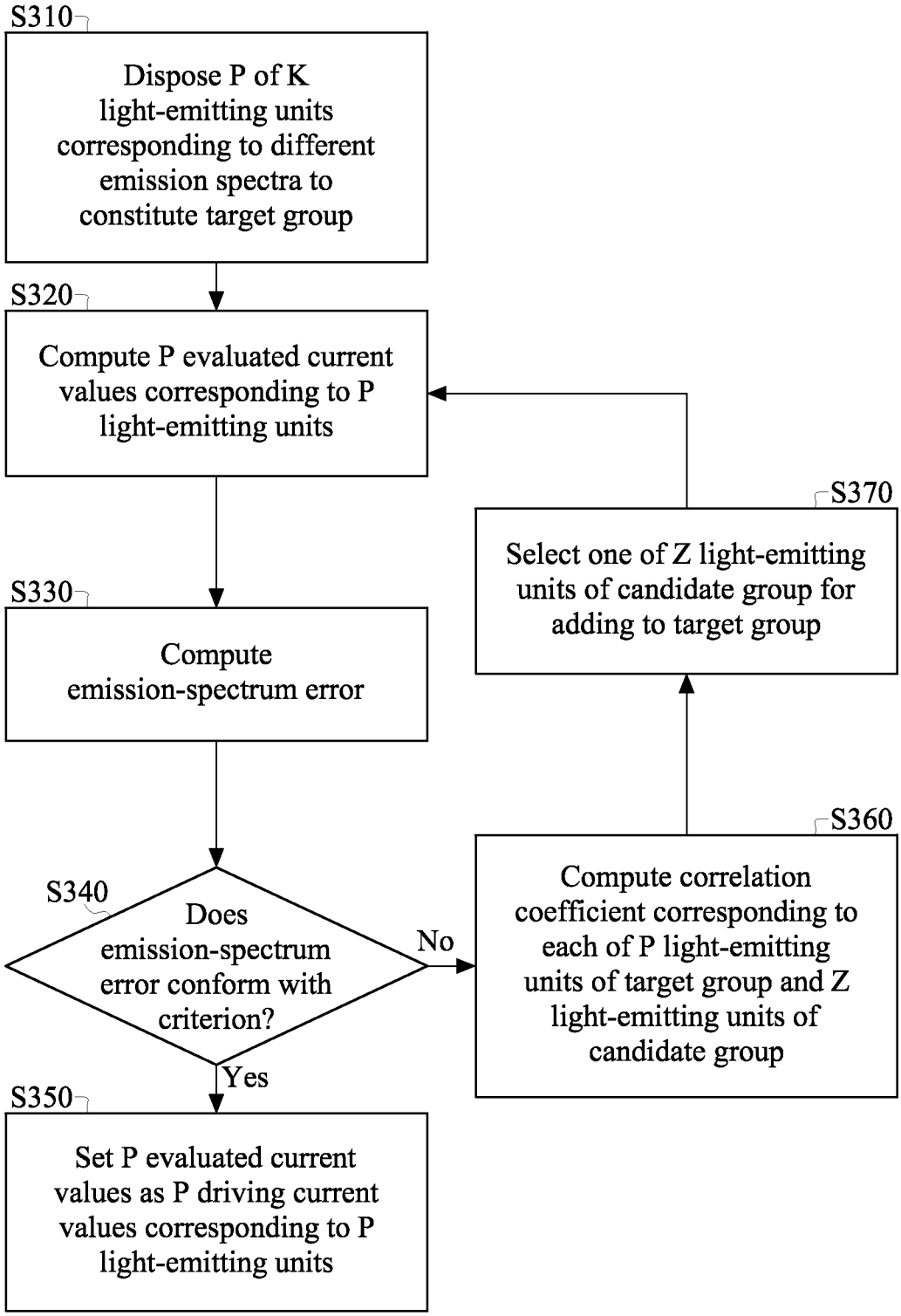
FIG. 3 is a flowchart of the driving method of a light-emitting module according to an embodiment of the present invention.

As to how the processing unit 13 decides the driving current value of every light-emitting unit among the K light-emitting units, or the driving method of the light-emitting module 1 according to an embodiment of the present invention, please refer to FIG. 1 to FIG. 3 together. As shown in the step S310, the processing unit 13 disposes P light-emitting units corresponding to different emission spectra so as to constitute a target group, wherein each of the light-emitting units corresponds to N power parameters in respectively N frequency sub-bands. Therefore, K light-emitting units are divided into a target group consisting of P light-emitting units and a candidate group consisting of Z light-emitting units, wherein K=P+Z. As shown in the step S320, the processing unit 13 computes P evaluated current values corresponding to the P light-emitting units according to a target spectrum and the said N×P power parameters corresponding to the P light-emitting units, wherein the target spectrum corresponds to N target-spectrum values in the N frequency sub-bands. As shown in the step S330, the processing unit 13 computes an emission-spectrum error according to the said target spectrum, the N×P power parameters and the P evaluated current values corresponding to the target group. As shown in the step S340, the processing unit 13 determines whether the emission-spectrum error conforms with a criterion.

When it is determined in the step S340 that the emission-spectrum error conforms with the criterion, the processing unit 13, as shown in the step S350, sets the P evaluated current values as P driving current values corresponding to the P light-emitting units. When the emission-spectrum error does not conform with the criterion, as shown in the step S360, the processing unit 13 computes for each of the Z light-emitting units a corresponding correlation coefficient according to the emission-spectrum error, the N×P power parameters corresponding to the P light-emitting units and the N×Z power parameters corresponding to the Z light-emitting units. As shown in the step S370, the processing unit 13 selects one of the Z light-emitting units according to the correlation coefficients for adding to the target group, wherein the correlation coefficient corresponding to the selected light-emitting unit conforms with a selection criterion. Then the processing unit 13 goes back to the step S320.

In order to explain the steps above in detail, please refer to FIG. 1 and FIG. 3. The following explanation takes the light-emitting unit 111 to the light-emitting unit 119 in FIG. 1 as an example. With regard to the step S310, in an embodiment, the method of selecting P light-emitting unit from the light-emitting unit 111 to the light-emitting unit 119 can be randomly selecting P (for example, P=3) light-emitting units. In another embodiment, the method can be selecting P light-emitting units in advance. In another embodiment, the method can be selecting every two light-emitting units from the light-emitting unit 111 to the light-emitting unit 119 and multiplying the power parameters corresponding to the frequency sub-bands of the emission spectra of the two light-emitting units to obtain the contingency coefficient of the two light-emitting units. Then the P light-emitting units with the lowest contingency coefficients with each other are selected.

Figure 4A:
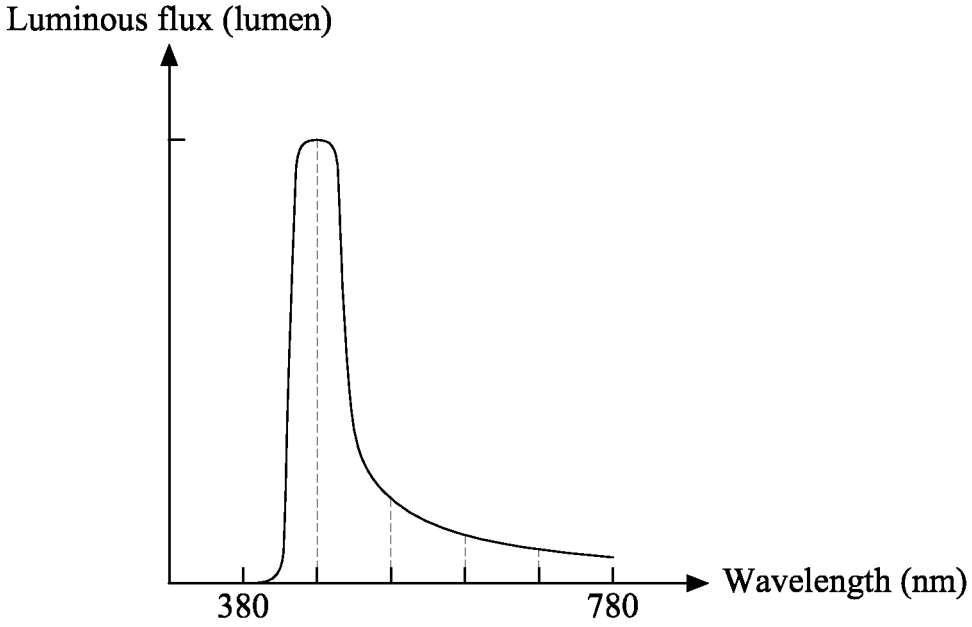
FIG. 4A is a diagram of the light-emitting spectrum of the light-emitting unit 111 according to an embodiment of the present invention.
Figure 4B:
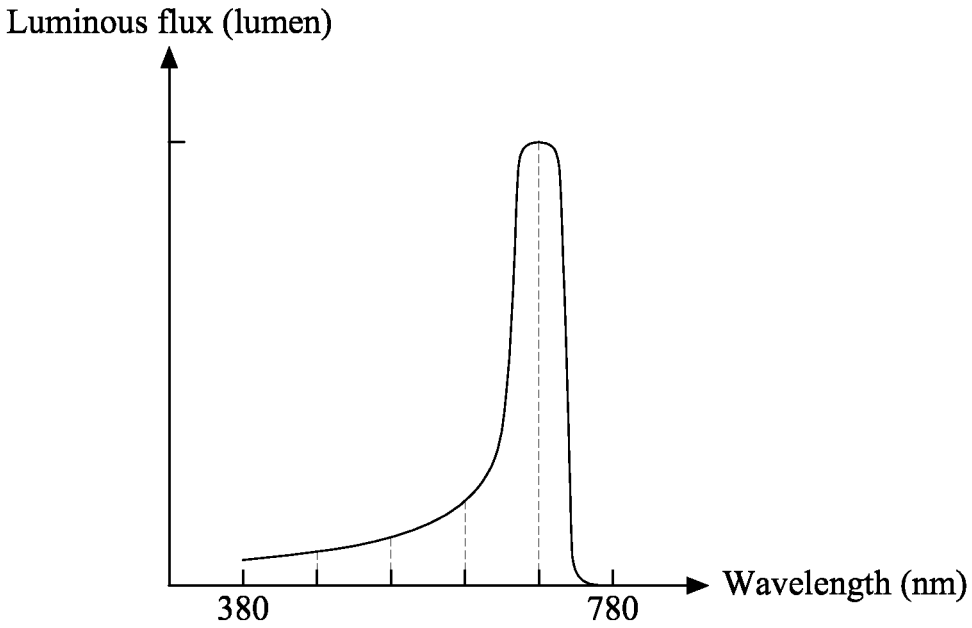
FIG. 4B is a diagram of the light-emitting spectrum of the light-emitting unit 113 according to an embodiment of the present invention.

Please refer to FIG. 4A and FIG. 4B. FIG. 4A is a diagram of the light-emitting spectrum of the light-emitting unit 111 according to an embodiment of the present invention. FIG. 4B is a diagram of the light-emitting spectrum of the light-emitting unit 113 according to an embodiment of the present invention. For example, as shown in FIG. 4A and FIG. 4B, the emission spectra of the light-emitting unit 111 and the light-emitting unit 113 are both divided into 5 frequency sub-bands and each frequency sub-band has its corresponding power parameter: the power parameters $A_{111_1}$ to $A_{111_5}$, and the power parameters $A_{113_1}$ to $A_{113_5}$. When computing the contingency coefficient of the light-emitting unit 111 and the light-emitting unit 113, the computation is based on the following equation:

$$R_{111_113} = \sum_{i=1}^{5} (A_{111_i} \cdot A_{113_i}) \tag{1}$$

In the above equation (1), $R_{111_113}$ represents the contingency coefficient of the light-emitting unit 111 and the light-emitting unit 113. The higher is a contingency coefficient of any two light-emitting units among the light-emitting unit 111 to the light-emitting unit 119, the closer are the emission spectra of these two light-emitting units. In contrast, a lower contingency coefficient of any two light-emitting units indicates that the difference between the emission spectra of these two light-emitting units is more significant. Therefore, if two light-emitting units are needed to be selected as the target group, the two light-emitting units with the lowest contingency coefficient are selected. Assuming that the two light-emitting units with the lowest contingency coefficient are the light-emitting unit 113 and the light-emitting unit 117, then if a third light-emitting unit is needed to be selected as a member of the target group, the light-emitting unit which has the lowest sum of contingency coefficients related to the light-emitting unit 113 and the light-emitting unit 117 is selected.

Besides, in another embodiment, the method of selecting P light-emitting units from the light-emitting unit 111 to the light-emitting unit 119 can be dividing the target spectrum and the emission spectrum of each light-emitting unit into N frequency sub-bands. Therefore, the target spectrum is divided into N frequency sub-bands and each frequency sub-band corresponds to a target-spectrum value, which is a target value of the luminous flux of the corresponding frequency sub-band. Meanwhile, the emission spectrum of each light-emitting unit is also divided into N frequency sub-bands and the N frequency sub-bands are in one-to-one correspondence with the N frequency sub-bands of the target spectrum. Each frequency sub-band of the N frequency sub-bands is also associated with a power parameter of the corresponding light-emitting unit in that sub-band. A power parameter of a frequency sub-band can be the luminous flux a light-emitting unit produces in the frequency sub-band when a unit driving current (for example, 1 mA) flowing through the light-emitting unit. Then the method selects arbitrarily or sequentially one light-emitting unit from the light-emitting unit 111 to the light-emitting unit 119, and obtains the sum of products of the N power parameters corresponding to the N frequency sub-bands of the emission spectrum of the selected light-emitting unit and the N target-spectrum values corresponding to N frequency sub-bands of the target spectrum. Regarding the N power parameters and the N target-spectrum values as two N-dimensional vectors, the sum of products can represent the projection of these two N-dimensional vectors. The correlation coefficient of the emission spectrum of every light-emitting unit and the target spectrum is obtained by this method.

For example, when calculating the correlation coefficient of the emission spectrum of the light-emitting unit 113 and the target spectrum, assuming that N=5, the computation is then based on the following equation:

$$R_{113_d} = \sum_{i=1}^{5} (A_{113_i} \cdot A_{d_i}) \tag{2}$$

In the equation (2), $R_{113_d}$ is the correlation coefficient between the emission spectrum of the light-emitting unit 113 and the target spectrum of the light-emitting unit 113, $A_{113_i}$ is the power parameter of the light-emitting unit 113 in the i-th frequency sub-band, and $A_{d_i}$ is the target-spectrum value of the target spectrum in the i-th frequency sub-band. After the correlation coefficient of the emission-spectrum and the target spectrum of every light-emitting unit is calculated, the P light-emitting units with the highest correlation coefficients are selected from the light-emitting unit 111 to the light-emitting unit 119 or from the light-emitting units with correlation coefficients higher than a threshold to constitute a target group.

About the step S320, in an embodiment, the step of computing the P evaluated current values corresponding to the P light-emitting units according to the N×P power parameters and the target spectrum is based on a non-negative least squares method. An algorithm of the method is described below. First, the N×P power parameters are organized to an N-by-P power parameter array $A_P$, wherein each column corresponds to a light-emitting unit and each row corresponds to a frequency sub-band. Then the N target spectrum corresponding to the N frequency sub-bands of the target spectrum are organized to an N-by-1 target spectrum array B. A P-by-1 intermediary current array $S_P$ is obtained from the following matrix operations, wherein the P elements of intermediary current array $S_P$ correspond to the P intermediary current values of the P light-emitting units respectively.

$$S_P=[(A_P)^T A_P]^{-1}(A_P)^T B \tag{3}$$

$(A_P)^T$ is the transpose matrix of the power parameter array $A_P$ and $[(A_P)^T A_P]^{-1}$ is the inverse matrix of $[(A_P)^T A_P]$. By the equation (3), the P intermediary current values corresponding to the P light-emitting units can be calculated in one go. Ideally, by using the P intermediary current values to drive the P light-emitting units, the mixture of light emitted from the P light-emitting units can be equal to the target spectrum. Subsequently, if the P intermediary current values are all non-negative, the P intermediary current values are taken as evaluated current values, the Z current values corresponding to the Z light-emitting units in the aforementioned candidate group are set to 0, and the P evaluated current values and the Z current values constitute a K-by-1 evaluated current array X.

In certain situations, some of the intermediary current values of the P intermediary current values are negative. In practice, it is not physically meaningful to drive a light-emitting unit with a negative current. Therefore, correcting the P intermediary current values of the intermediary current array $S_P$ to non-negative values is necessary. The method is described below in specifics. First, the calculated P intermediary current values are organized to a P-by-1 record current array $X_P$. If the intermediary current values have not been calculated, every element of the record current array $X_P$ is set to 0. Then, a negative current value is found from the P intermediary current values, and according to the record current array $X_P$, the found negative current value, and the P intermediary current values, a corrected record current array $X_P$ is calculated. The light-emitting units corresponding to the zero-valued elements in the corrected record current array $X_P$ are moved to the candidate group from the target group. Then the step S230 is repeated until every element in the intermediary current array $S_P$ is larger than 0. The intermediary current array $S_P$ is hereby taken as the record current array $X_P$, and the record current array $X_P$ and the Z current values (all zeros) corresponding to the Z light-emitting units in the candidate group constitute the evaluated current array X.

About the step S330, in an embodiment, the step of computing an emission-spectrum error according to the target spectrum, the N×P power parameters and the P evaluated current values corresponding to the target group is executed. It is based on the following equation:

$$E=B-AX, \tag{4}$$

wherein E is an N-by-1 emission-spectrum error array, and each element of the emission-spectrum error array E corresponds to one emission-spectrum error value of the N frequency sub-bands. The evaluated current array X is a K-by-1 array. The array A is an N-by-K matrix composed of the N×P power parameters of the P light-emitting units of the target group and the N×Z power parameters of the Z light-emitting units of the candidate group. Because the evaluated current array X has Z elements (current values) of 0 and P current values from the intermediary current array $S_P$, the equation (4) can also be rewritten as the following equation (4-1):

$$E=B-A_PS_P \tag{4-1}$$

About the step S340, in an embodiment, when determining whether the emission-spectrum error conforms with the criterion, the criterion is "the absolute value of every element of the emission-spectrum error array E is less than a default tolerance", wherein the default tolerance is a positive real number. In another embodiment, the criterion is "the sum of the squares of certain elements of the emission-spectrum error array E is less than a default tolerance", wherein the default tolerance is a positive real number and the certain elements can be selected in advance or can be all the elements. In yet another embodiment, the criterion is "the sum of the squares of certain elements of the emission-spectrum error array E calculated this time is the least among those of many calculated array E's". There can be other criteria in accordance with the spirit of the present invention.

About the step S360, in an embodiment, computing for each of the Z light-emitting units of the candidate group and each of the P light-emitting units of the target group a corresponding correlation coefficient according to the emission-spectrum error, the N×P power parameters corresponding to the P light-emitting units of the target group, and the N×Z power parameters corresponding to the Z light-emitting units of the candidate group is based on the following equation:

$$w=A^T(B-AX), \tag{5}$$

wherein w is an N-by-1 correlation coefficient array, A is the N-by-K power parameter array, and each column of the power parameter array A corresponds to one of the K light-emitting units. Based on the equation (5) above, the correlation coefficient of each light-emitting unit of the K light-emitting units and the emission-spectrum error can be calculated.

About the step S370, in an embodiment, a light-emitting unit is selected from the Z light-emitting units of the candidate group to add to the target group, wherein the correlation coefficient corresponding to the selected light-emitting unit conforms with the selection criterion. The selection criterion can be selecting from the Z light-emitting units the light-emitting unit corresponding to the highest correlation coefficient. In another embodiment, the criterion can be, given a correlation coefficient threshold, selecting from the Z light-emitting units one of a number of light-emitting units with correlation coefficients higher than the threshold. By the steps S360 and S370, a suitable light-emitting unit can be found to compensate for the emission-spectrum error.

Figure 5:
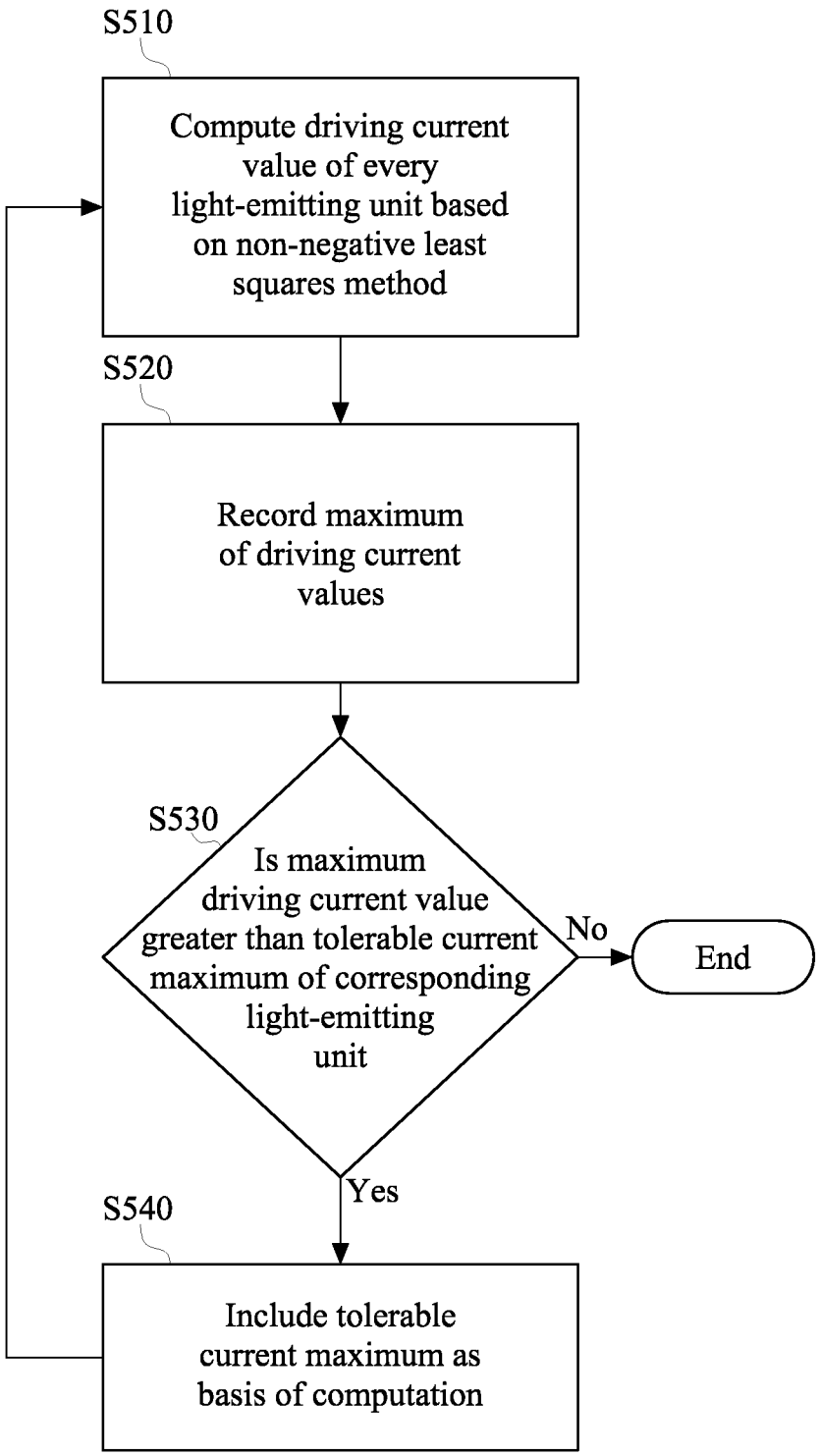
FIG. 5 is a flowchart of the driving method of a light-emitting module according to an embodiment of the present invention.

In another embodiment of the present invention, please refer to FIG. 5. FIG. 5 is a flowchart of the driving method of a light-emitting module according to an embodiment of the present invention. First, as shown in the Step S510, the evaluated current value of every light-emitting unit among a plurality of light-emitting units is calculated by a non-negative least squares method. The non-negative least squares method is as shown in FIG. 3 and described in relevant paragraphs. As further shown in the step S520, the maximum evaluated current value among the evaluated current values corresponding to said light-emitting units is recorded. As shown in S530, the method compares the maximum evaluated current value with a tolerable current maximum of the corresponding light-emitting unit. If the maximum evaluated current value is not larger than the tolerable current maximum, the method terminates and takes the said evaluated current values as the driving current values to drive the corresponding a plurality of light-emitting units. If the maximum evaluated current value is larger than the tolerable current maximum, then as shown in the step S540, the method further includes the tolerable current maximum as a basis of computation, and then goes back to the step S510 to compute the a plurality of evaluated current values of the a plurality of light-emitting units by the non-negative least squares method. Therefore, in this embodiment, the calculated driving current values are not larger than the tolerable current maximum.

Specifically, in the step S540, if the maximum evaluated current value is larger than the tolerable current maximum, a correcting procedure is executed. According to the procedure, a first light-emitting unit corresponding to the maximum evaluated current value is found among the P light-emitting units in the target group. Then the tolerable current maximum is taken as the evaluated current value corresponding to the first light-emitting unit. After that, going back to the step S510, the first evaluated current value corresponding to the first light-emitting unit is fixed, and the P-1 evaluated current values of the P-1 light-emitting units among the P light-emitting units except the first light-emitting unit are computed.

Figure 6:
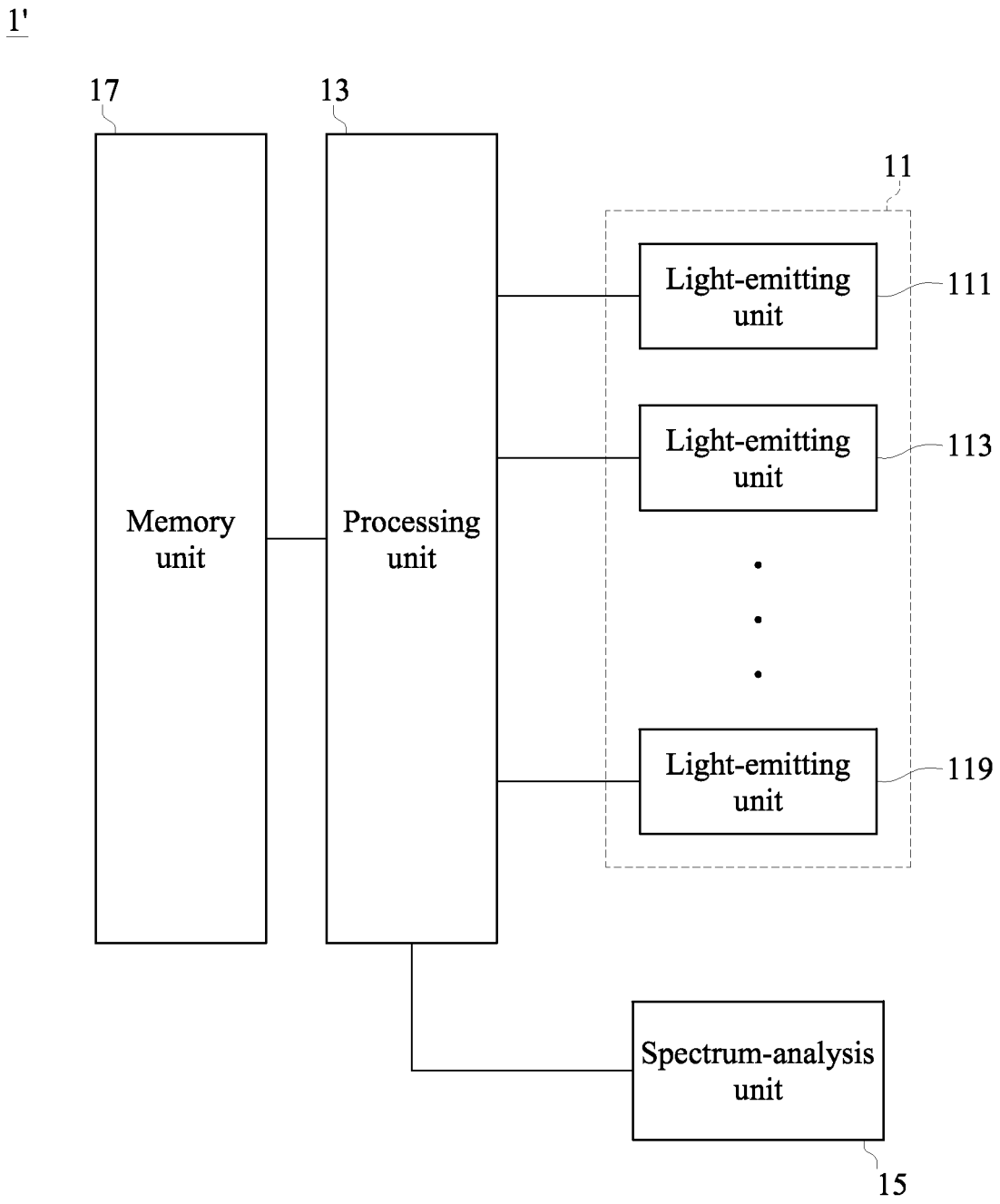
FIG. 6 is a functional block diagram of a light-emitting module according to another embodiment of the present invention.

In addition, because it is necessary to monitor and update the emission spectra of the light-emitting units, the method in an embodiment of the present invention for monitoring and updating the emission spectra of the light-emitting units is described below in detail. Please refer to FIG. 6. FIG. 6 is a functional block diagram of a light-emitting module according to an embodiment of the present invention. As shown in FIG. 6, the light-emitting module 1', compared to the light-emitting module 1 in FIG. 1, further comprises a spectrum-analysis unit 15 and a memory unit 17. The spectrum-analysis unit 15 and the memory unit 17 are each electrically connected with the processing unit 13. In a first embodiment, the spectrum-analysis unit 15, when enabled, is adapted for detecting and analyzing the emission spectrum of one of the light-emitting units 111 to 119. In a second embodiment, the spectrum-analysis unit 15, when enabled, is adapted for detecting and analyzing the spectrum of the light emitted from the light-emitting unit 111 to 119 and mixed by the light-emitting module 1'. The memory unit 17 is adapted for storing the power parameter data corresponding to the light-emitting units 111 to 119, the target spectrum, and temporary data needed by the processing unit 13. In accordance with the spirit of the present invention, the memory unit 17 is, for example, a static random access memory, dynamic random access memory, read-only memory, electrically programmable read-only memory, flash memory or another memory device with data storing functionality and is not limited to volatile memory or non-volatile memory.

In the first embodiment, every time the light-emitting module 1' is enabled, the light-emitting units 111 to 119 are sequentially enabled and disabled, wherein only one light-emitting unit is enabled at the same time. Meanwhile, the spectrum-analysis unit 15 sequentially detects and analyzes the emission spectrum of each of the light-emitting units 111 to 119 and the processing unit 13 respectively updates the 9 emission spectra obtained by analysis by the spectrum-analysis unit 15 to the corresponding records in the memory unit 17. Then the process as shown in FIG. 3 is executed to employ the light-emitting units 111 to 119 obtain such light whose emission spectrum approximates to the target spectrum. By this method, because the response time of the light-emitting units, especially as LEDs, is very fast, the above process can be completed in a very short time, so that users do not notice any delay in the enabling of the light-emitting module 1'.

In the second embodiment, with the light-emitting module 1' enabled, every once in a while the light-emitting units 111 to 119 can be quickly and sequentially turned off and enabled again, or quickly turned on and turned off again (depending on whether the light-emitting unit is enabled now that the light-emitting module 1' is turned on). According to FIG. 3, after the light-emitting module 1' is turned on, the driving current of every light-emitting unit among the light-emitting units 111 to 119 is fixed, so the N power parameters corresponding to each light-emitting unit of the light-emitting units 111 to 119 can be computed accordingly.

For example, assuming that the light-emitting unit 115 is driven by a current of 0.5 A when the light-emitting module 1' is turned on, the spectrum-analysis unit 15 first detects and analyzes a first spectrum emitted by the light-emitting module 1' in a normal situation, and then the processing unit 13 quickly turns off the light-emitting unit 115. At this moment, the spectrum-analysis unit 15 detects and analyzes a second spectrum emitted by the light-emitting module 1' when the light-emitting unit 115 is turned off, and then the spectrum-analysis unit 15 transmits the first spectrum and the second spectrum to the processing unit 13. The processing unit 13 computes the N power parameters to which the light-emitting unit 115 corresponds in the N frequency sub-bands according to the first spectrum, the second spectrum, and the 0.5-A current driving the light-emitting unit 115. The processing unit 13 updates the N power parameters corresponding to the light-emitting unit 115 and stored in the memory unit 17 with the computed N power parameters. By this process, the power parameters of every light-emitting unit can be updated at any time and the driving current of every light-emitting unit in the light-emitting module 1' can be adjusted according to the present power parameters.

In summary, according to the light-emitting module and the driving method of the present invention, the driving current value for driving every light-emitting unit can be computed according to a target spectrum and a plurality of power parameters corresponding to a plurality of light-emitting units. Moreover, an emission-spectrum error resulting from driving the light-emitting units with the driving current values is computed. When the spectrum error value is not as expected, further finds another light-emitting unit with the highest correlation coefficient related to the spectrum error value and repeats the process of the present invention. Finally, a plurality of light-emitting units and a plurality of corresponding driving currents are obtained so that the spectrum corresponding to their mixed light approximates the target spectrum.

The foregoing description has been presented for purposes of illustration. It is not exhaustive and does not limit the invention to the precise forms or embodiments disclosed. Modifications and adaptations will be apparent to those skilled in the art from consideration of the specification and practice of the disclosed embodiments of the invention. It is intended, therefore, that the specification and examples be considered as exemplary only, with a true scope and spirit of the invention being indicated by the following claims and their full scope of equivalents.

What is claimed is:

1. A driving method of a light-emitting module, comprising:

disposing P light-emitting units corresponding to different emission spectra so as to constitute a target group, each of the light-emitting units corresponding to N power parameters in respectively N frequency sub-bands, the light-emitting module comprising the target group;

computing P evaluated current values corresponding to the P light-emitting units according to a target spectrum and the N×P power parameters corresponding to the P light-emitting units, the target spectrum having N target-spectrum values in the N frequency sub-bands;

computing an emission-spectrum error according to the target spectrum, the N×P power parameters and the P evaluated current values corresponding to the target group;

determining whether the emission-spectrum error conforms with a criterion; and setting the P evaluated current values as P driving current values corresponding to the P light-emitting units when the emission-spectrum error conforms with the criterion;

wherein P and N are positive integers.

2. The driving method of claim 1, wherein the light-emitting module further comprises a candidate group consisting of Z light-emitting units, wherein each of the Z light-emitting units corresponds to N power parameters in respectively the N frequency sub-bands, and the driving method further comprising, when the emission-spectrum error does not conform with the criterion:

computing for each of the Z light-emitting units a corresponding correlation coefficient according to the emission-spectrum error, the N×P power parameters corresponding to the P light-emitting units, and the N×Z power parameters corresponding to the Z light-emitting units; and selecting one of the Z light-emitting units according to the correlation coefficients for adding to the target group;

wherein the candidate group and the target group are mutually exclusive, and Z is a positive integer.

3. The driving method of claim 1, wherein computing the P evaluated current values is based on:

$$S_P=[(A_P)^T A_P]^{-1}(A_P)^T B$$

wherein $S_P$ is a P-by-1 array, and each element of $S_P$ corresponds to one of the P evaluated current values;

wherein $A_P$ is an N-by-P array, and each column of $A_P$ consists of the N power parameters corresponding to one of the P light-emitting units;

wherein B is an N-by-1 array, and each element of B corresponds to one of the N target-spectrum values.

4. The driving method of claim 1, wherein computing the emission-spectrum error is based on:

$$E=B-A_P S_P$$

wherein E is an N-by-1 array, and each element of E corresponds to an error value of one of the N frequency sub-bands;

wherein $S_P$ is a P-by-1 array, and each element of $S_P$ corresponds to one of the P evaluated current values;

wherein $A_P$ is an N-by-P array, and each column of $A_P$ consists of the N power parameters corresponding to one of the P light-emitting units;

wherein B is an N-by-1 array, and each element of B corresponds to one of the N target-spectrum values.

5. The driving method of claim 1, wherein computing the P evaluated current values is based on a non-negative least squares method.

6. The driving method of claim 1, wherein setting the P evaluated current values as the P driving current values comprises:

finding a maximum evaluated current value among the P evaluated current values;

comparing the maximum evaluated current value with a tolerable current maximum;

executing a correcting procedure if the maximum evaluated current value is greater than the tolerable current maximum, the correcting procedure comprising:

finding among the P light-emitting units a first light-emitting unit corresponding to the maximum evaluated current value;

taking the tolerable current maximum as the evaluated current value corresponding to the first light-emitting unit; and returning to computing the P evaluated current values, wherein the P-1 evaluated current values corresponding to the P light-emitting units excluding the first light-emitting unit are computed further according to the tolerable current maximum; and taking the P evaluated current values as the P driving current values if the maximum evaluated current value is not greater than the tolerable current maximum.

7. A light-emitting module, comprising:

a target group consisting of P light-emitting units corresponding to different emission spectra, each of the light-emitting units corresponding to N power parameters in respectively N frequency sub-bands; and a processing unit electrically connected with the P light-emitting units, adapted for computing P evaluated current values corresponding to the P light-emitting units according to a target spectrum and the N×P power parameters corresponding to the P light-emitting units, for computing an emission-spectrum error according to the target spectrum, the N×P power parameters, and the P evaluated current values corresponding to the target group, and for determining whether the emission-spectrum error conforms with a criterion, wherein the target spectrum has N target-spectrum values in the N frequency sub-bands;

wherein the processing unit sets the P evaluated current values as P driving current values corresponding to the P light-emitting units when the emission-spectrum error conforms with the criterion, and P and N are positive integers.

8. The light-emitting module of claim 7, further comprising a candidate group consisting of Z light-emitting units, wherein each of the Z light-emitting units corresponds to N power parameters in respectively the N frequency sub-bands, wherein the candidate group and the target group are mutually exclusive, wherein Z is a positive integer, and wherein when the emission-spectrum error does not conform with the criterion, the processing unit computes for each of the Z light-emitting units a corresponding correlation coefficient according to the emission-spectrum error, the N×P power parameters corresponding to the P light-emitting units, and the N×Z power parameters corresponding to the Z light-emitting units, and selects one of the Z light-emitting units according to the correlation coefficients for adding to the target group.

9. The light-emitting module of claim 7, wherein the processing unit computes the P evaluated current values based on:

$$S_P=[(A_P)^T A_P]^{-1}(A_P)^T B$$

wherein $S_P$ is a P-by-1 array, and each element of $S_P$ corresponds to one of the P evaluated current values;

wherein $A_P$ is an N-by-P array, and each column of $A_P$ consists of the N power parameters corresponding to one of the P light-emitting units;

wherein B is an N-by-1 array, and each element of B corresponds to one of the N target-spectrum values.

10. The light-emitting module of claim 7, wherein the processing unit computes the emission-spectrum error based on:

$$E=B-A_P S_P$$

wherein E is an N-by-1 array, and each element of E corresponds to an error value of one of the N frequency sub-bands;

wherein $S_P$ is a P-by-1 array, and each element of $S_P$ corresponds to one of the P evaluated current values;

wherein $A_P$ is an N-by-P array, and each column of $A_P$ consists of the N power parameters corresponding to one of the P light-emitting units;

wherein B is an N-by-1 array, and each element of B corresponds to one of the N target-spectrum values.

11. The light-emitting module of claim 7, wherein the processing unit computes the P evaluated current values based on a non-negative least squares method.

12. The light-emitting module of claim 7, wherein when the processing unit sets the P evaluated current values as the P driving current values, the processing unit finds a maximum evaluated current value among the P evaluated current values, compares the maximum evaluated current value with a tolerable current maximum, executes a correcting procedure if the maximum evaluated current value is greater than the tolerable current maximum, and takes the P evaluated current values as the P driving current values if the maximum evaluated current value is not greater than the tolerable current maximum, wherein the correcting procedure comprises:

finding among the P light-emitting units a first light-emitting unit corresponding to the maximum evaluated current value;

taking the tolerable current maximum as the evaluated current value corresponding to the first light-emitting unit; and returning to computing the P evaluated current values, wherein the processing unit computes, further according to the tolerable current maximum, the P-1 evaluated current values corresponding to the P light-emitting units excluding the first light-emitting unit.

* * * * *

UNITED STATES PATENT AND TRADEMARK OFFICE

CERTIFICATE OF CORRECTION

PATENT NO. : 9,232,600 B2
APPLICATION NO. : 14/546323
DATED : January 5, 2016
INVENTOR(S) : Hu et al.

It is certified that error appears in the above-identified patent and that said Letters Patent is hereby corrected as shown below:

On the title page item (71), under "Applicant", in Column 1, Line 1, delete "Guishan Township", therefor.

On the title page item (72), under "Inventors", in Column 1, Line 1, delete "Guishan Township" and insert -- Taoyuan County --, therefor.

On the title page item (72), under "Inventors", in Column 1, Line 2, delete "Guishan Township" and insert -- Taoyuan County --, therefor.

Signed and Sealed this
Fourteenth Day of June, 2016

Michelle K. Lee

Michelle K. Lee
*Director of the United States Patent and Trademark Office*